US009327338B2

(12) United States Patent
Boysel et al.

(10) Patent No.: US 9,327,338 B2
(45) Date of Patent: May 3, 2016

(54) KNOCKOUT FOR USE WHILE NECKING A METAL CONTAINER, DIE SYSTEM FOR NECKING A METAL CONTAINER AND METHOD OF NECKING A METAL CONTAINER

(71) Applicant: ALCOA INC., Pittsburgh, PA (US)

(72) Inventors: Darl G. Boysel, Delmont, PA (US); Robert E. Dick, Cheswick, PA (US); Gary L. Myers, Sarver, PA (US); David J. McNeish, Greensburg, PA (US)

(73) Assignee: Alcoa Inc., Pittsburgh, PA (US)

( * ) Notice: Subject to any disclaimer, the term of this patent is extended or adjusted under 35 U.S.C. 154(b) by 418 days.

(21) Appl. No.: 13/722,290

(22) Filed: Dec. 20, 2012

(65) Prior Publication Data

US 2014/0174144 A1 Jun. 26, 2014

(51) Int. Cl.

| | |
|---|---|
| ***B21D 37/00*** | (2006.01) |
| ***B21D 41/04*** | (2006.01) |
| ***B21D 51/26*** | (2006.01) |

(52) U.S. Cl.

CPC ..... *B21D 51/2669* (2013.01); *B21D 37/00* (2013.01); *B21D 41/04* (2013.01); *B21D 51/2638* (2013.01)

(58) Field of Classification Search

CPC ..... B21D 51/2615; B21D 51/2638; B21D 51/2646; B21D 41/00; B21D 41/04; B21D 45/06; B21D 45/065; B21D 45/08; B21D 45/02; B21D 45/04

USPC ..... 72/344, 345, 427, 715, 347, 349

See application file for complete search history.

(56) References Cited

U.S. PATENT DOCUMENTS

| | | | | |
|---|---|---|---|---|
| 3,759,205 | A | 9/1973 | Dolveck | |
| 3,857,917 | A | 12/1974 | Reade | |
| 3,898,828 | A | 8/1975 | Cassai et al. | |
| 3,972,217 | A * | 8/1976 | Misonoo | 72/344 |
| 3,995,572 | A | 12/1976 | Saunders | |
| 4,163,380 | A | 8/1979 | Masoner | |

(Continued)

FOREIGN PATENT DOCUMENTS

| | | |
|---|---|---|
| CL | 2234-96 | 12/1996 |
| CN | 2275486 | 3/1998 |

(Continued)

OTHER PUBLICATIONS

International Search Report and Written Opinion of the International Searching Authority dated Feb. 18, 2014 from International Application No. PCT/US2013/074126.

(Continued)

*Primary Examiner* — Shelley Self
*Assistant Examiner* — Peter Iannuzzi
(74) *Attorney, Agent, or Firm* — Greenberg Traurig, LLP

(57) ABSTRACT

A knockout has a support surface and the support surface has: (i) a first knockout outer diameter capable of supporting the first inner diameter of a container side wall when the knockout is inserted into an opening of the metal container and when the metal container is being necked with a necking die; and (ii) a second knockout outer diameter capable of supporting the second inner diameter of the container side wall when the knockout is inserted into the opening of the metal container and when the metal container is being necked with the necking die, and wherein the first knockout outer diameter is larger than the second knockout outer diameter.

21 Claims, 5 Drawing Sheets

(56) References Cited

U.S. PATENT DOCUMENTS

| | | | | |
|---|---|---|---|---|
| 4,173,883 | A | 11/1979 | Boik | |
| 4,346,580 | A * | 8/1982 | Saunders | 72/344 |
| 4,947,667 | A | 8/1990 | Gunkel et al. | |
| 5,040,682 | A | 8/1991 | Palisin, Jr. et al. | |
| 5,058,408 | A | 10/1991 | Leftault, Jr. et al. | |
| 5,160,031 | A | 11/1992 | Palisin, Jr. et al. | |
| 5,261,558 | A | 11/1993 | Claydon | |
| 5,351,852 | A | 10/1994 | Trageser et al. | |
| 5,355,710 | A | 10/1994 | Diekhoff | |
| 5,394,727 | A | 3/1995 | Diekhoff et al. | |
| 5,470,405 | A | 11/1995 | Wyatt-Mair et al. | |
| 5,487,295 | A | 1/1996 | Diekhoff et al. | |
| 5,522,248 | A | 6/1996 | Diekhoff et al. | |
| 5,572,893 | A | 11/1996 | Goda et al. | |
| 5,645,190 | A | 7/1997 | Goldberg | |
| 5,699,932 | A | 12/1997 | Claydon et al. | |
| 5,705,240 | A | 1/1998 | Machii et al. | |
| 5,711,178 | A | 1/1998 | Hogendoorn et al. | |
| 5,713,235 | A | 2/1998 | Diekhoff | |
| 5,724,848 | A | 3/1998 | Aschberger | |
| 5,727,414 | A | 3/1998 | Halasz et al. | |
| 5,746,080 | A | 5/1998 | Hartman et al. | |
| 5,755,130 | A | 5/1998 | Tung et al. | |
| 5,776,270 | A | 7/1998 | Biondich | |
| 5,822,843 | A | 10/1998 | Diekhoff et al. | |
| 5,832,766 | A | 11/1998 | Hartman et al. | |
| 5,851,685 | A | 12/1998 | McEldowney | |
| 5,899,104 | A | 5/1999 | Brilman et al. | |
| 5,899,105 | A | 5/1999 | Erhard | |
| 5,899,106 | A | 5/1999 | Heurteboust et al. | |
| 5,902,086 | A | 5/1999 | Enoki | |
| 5,916,317 | A | 6/1999 | Willoughby et al. | |
| 5,938,389 | A | 8/1999 | Shore et al. | |
| 5,960,659 | A | 10/1999 | Hartman et al. | |
| 5,970,767 | A | 10/1999 | Hartman et al. | |
| 6,038,910 | A | 3/2000 | McClung | |
| 6,079,244 | A | 6/2000 | Robinson et al. | |
| 6,085,563 | A | 7/2000 | Heiberger et al. | |
| 6,112,932 | A | 9/2000 | Holdren | |
| D435,454 | S | 12/2000 | Munn et al. | |
| 6,250,122 | B1 | 6/2001 | Robinson et al. | |
| 6,286,357 | B1 * | 9/2001 | D'Amore et al. | 72/379.4 |
| 6,308,545 | B2 | 10/2001 | Burgel et al. | |
| 6,338,263 | B1 | 1/2002 | Obata et al. | |
| 6,343,496 | B1 | 2/2002 | Hanna et al. | |
| D455,961 | S | 4/2002 | Edson et al. | |
| 6,374,657 | B1 | 4/2002 | Kirk et al. | |
| 6,430,984 | B2 | 8/2002 | Zeiter et al. | |
| 6,442,991 | B1 | 9/2002 | Rojek | |
| D464,264 | S | 10/2002 | Edson et al. | |
| 6,543,636 | B1 | 4/2003 | Flecheux et al. | |
| 6,655,181 | B2 | 12/2003 | Morales | |
| 6,701,764 | B2 | 3/2004 | Bruck et al. | |
| D490,317 | S | 5/2004 | Chang | |
| 6,779,677 | B2 | 8/2004 | Chupak | |
| 6,802,196 | B2 | 10/2004 | Gong et al. | |
| 6,886,722 | B2 | 5/2005 | Flecheux | |
| 6,907,653 | B2 | 6/2005 | Chupak | |
| 6,945,085 | B1 | 9/2005 | Goda | |
| D512,315 | S | 12/2005 | Holm | |
| D514,937 | S | 2/2006 | Chang | |
| 7,003,999 | B2 | 2/2006 | Campo et al. | |
| 7,004,000 | B2 | 2/2006 | Campo et al. | |
| 7,013,697 | B2 | 3/2006 | Barber | |
| 7,024,912 | B2 | 4/2006 | Campo et al. | |
| 7,107,804 | B2 | 9/2006 | Gong et al. | |
| 7,140,223 | B2 | 11/2006 | Chupak | |
| 7,188,499 | B2 | 3/2007 | Ogaki et al. | |
| 7,670,094 | B2 | 3/2010 | Boltshauser | |
| 7,726,162 | B2 | 6/2010 | Druesne et al. | |
| 7,726,165 | B2 | 6/2010 | Myers et al. | |
| 7,954,351 | B2 | 6/2011 | Myers et al. | |
| 7,954,354 | B2 | 6/2011 | Myers et al. | |
| 8,322,183 | B2 | 12/2012 | Myers et al. | |
| 8,555,692 | B2 | 10/2013 | Myers et al. | |
| 2002/0162371 | A1 | 11/2002 | Hamstra et al. | |
| 2003/0102278 | A1 | 6/2003 | Chupak | |
| 2003/0115923 | A1 | 6/2003 | Veen et al. | |
| 2004/0011112 | A1 | 1/2004 | Lentz et al. | |
| 2004/0035871 | A1 | 2/2004 | Chupak | |
| 2004/0040970 | A1 | 3/2004 | Weijers et al. | |
| 2004/0194522 | A1 | 10/2004 | Hamstra et al. | |
| 2004/0216506 | A1 | 11/2004 | Simpson et al. | |
| 2005/0193796 | A1 | 9/2005 | Heiberger et al. | |
| 2006/0071035 | A1 | 4/2006 | Christ et al. | |
| 2007/0295051 | A1 * | 12/2007 | Myers et al. | 72/379.4 |
| 2008/0116212 | A1 | 5/2008 | Jonker | |
| 2009/0274957 | A1 | 11/2009 | Goda et al. | |
| 2010/0107719 | A1 * | 5/2010 | Geho | 72/370.02 |

FOREIGN PATENT DOCUMENTS

| | | |
|---|---|---|
| DE | 4113428 | 10/1992 |
| EP | 0492861 | 7/1992 |
| EP | 0599583 | 6/1994 |
| EP | 0721384 | 8/1994 |
| EP | 0767241 | 4/1997 |
| EP | 0845315 | 6/1998 |
| EP | 0852973 | 7/1998 |
| EP | 0852974 | 7/1998 |
| EP | 0854823 | 7/1998 |
| EP | 1064413 | 1/2001 |
| EP | 0853513 | 8/2001 |
| EP | 0928229 | 8/2001 |
| EP | 0853514 | 10/2001 |
| EP | 0853515 | 10/2001 |
| EP | 1294622 | 3/2003 |
| EP | 1506824 | 2/2005 |
| EP | 1618974 | 1/2006 |
| EP | 1461262 | 2/2007 |
| EP | 1586393 | 9/2007 |
| EP | 2111935 | 10/2009 |
| FR | 2495507 | 6/1982 |
| FR | 2762383 | 10/1998 |
| FR | 2876305 | 4/2006 |
| GB | 2206304 | 1/1989 |
| JP | 63-183738 | 7/1988 |
| JP | 02-104430 | 4/1990 |
| JP | 06-238818 | 8/1994 |
| JP | 07242226 | 9/1995 |
| JP | 2000015371 | 1/2000 |
| JP | 2001-179375 | 7/2001 |
| WO | 9111274 | 8/1991 |
| WO | 9111275 | 8/1991 |
| WO | 9114626 | 10/1991 |
| WO | 9322079 | 11/1993 |
| WO | 9505253 | 2/1995 |
| WO | 9515227 | 6/1995 |
| WO | 9615865 | 5/1996 |
| WO | 9625256 | 8/1996 |
| WO | 9640457 | 12/1996 |
| WO | 9711889 | 4/1997 |
| WO | 9712704 | 4/1997 |
| WO | 9712705 | 4/1997 |
| WO | 9712706 | 4/1997 |
| WO | 9747408 | 12/1997 |
| WO | 9805445 | 2/1998 |
| WO | 9839117 | 9/1998 |
| WO | 9843757 | 10/1998 |
| WO | 9932242 | 7/1999 |
| WO | 9937826 | 7/1999 |
| WO | 0151231 | 7/2001 |
| WO | 0158618 | 8/2001 |
| WO | 0196209 | 12/2001 |
| WO | 03039975 | 5/2003 |
| WO | 03047991 | 6/2003 |
| WO | 2004058597 | 7/2004 |
| WO | 2005000498 | 1/2005 |
| WO | 2005099926 | 10/2005 |
| WO | 2006033376 | 3/2006 |
| WO | 2006040116 | 4/2006 |
| WO | 2006078690 | 7/2006 |
| WO | 2008002741 | 1/2008 |

(56) References Cited

FOREIGN PATENT DOCUMENTS

| | | |
|---|---|---|
| WO | 2008110679 | 9/2008 |
| WO | 2009130034 | 10/2009 |
| ZA | 200810096 | 12/2009 |

OTHER PUBLICATIONS

European Search Report dated Jul. 15, 2011 from European Application No. 11163270.

International Search Report and Written Opinion of the International Searching Authority dated Nov. 19, 2007 from International Application No. PCT/US2007/072091.

International Search Report and Written Opinion of the International Searching Authority dated Nov. 19, 2007 from International Application No. PCT/US2007/070083.

State Intellectual Property Office of the People's Republic of China Search Report dated Dec. 19, 2013.

* cited by examiner

KNOCKOUT FOR USE WHILE NECKING A METAL CONTAINER, DIE SYSTEM FOR NECKING A METAL CONTAINER AND METHOD OF NECKING A METAL CONTAINER

BACKGROUND

It is well-known to neck the top side wall of drawn and ironed metal containers with a necking die to narrow the opening of the metal containers to accept a lid or to form the metal container into a bottle. Necking the top side wall of drawn and ironed metal containers requires a knockout, which works in harmony with the necking die.

SUMMARY

One embodiment of a die system comprises a metal container, a necking die and a knockout. The metal container has an opening and a container side wall. The container side wall has a first inner diameter and a second inner diameter, wherein the first inner diameter of the container side wall is at least 0.001 inches greater than the second inner diameter of the container side wall. The necking die has a working surface comprising a land. The knockout has a support surface. The support surface has a first knockout outer diameter capable of supporting the first inner diameter of the container side wall when the knockout is inserted into the opening of the metal container and when the metal container is being necked with the necking die; and a second knockout outer diameter capable of supporting the second inner diameter of the container side wall when the knockout is inserted into the opening of the metal container and when the metal container is being necked with the necking die. The first knockout outer diameter is larger than the second knockout outer diameter.

The metal container may be any type of metal container including beverage cans and cups, aerosol cans and food containers. The metal container can be made by any process known in the art including but not limited to: drawing and ironing; impact extrusion; spin forming; draw and redraw; and deep drawing.

A container side wall is the body of the container as shown in FIG. 2.

A necking die is a die used to narrow a diameter of a metal container via axial movement with respect to the metal container.

A working surface of the necking die is the surface of the necking die that directly contacts a metal container when the necking die is narrowing a diameter of the metal container.

A land is the portion of the inner diameter of the working surface of the necking die having the smallest inner diameter.

A knockout, also known as a pilot, fits inside the metal container during necking and provides a support surface against which the working surface of the necking die pushes the metal container during necking. In some embodiments the knockout helps the container to be removed from the die after necking. The knockout moves coaxially relative to the necking die.

A support surface of the knockout is capable of supporting the metal container during necking and prevents the metal container from wrinkling, buckling, rupturing or other defects when the metal container is being narrowed with the necking die.

In some embodiments, capable of supporting means that during necking and when the knockout is inserted or partially inserted into the metal container the clearance between the knockout and the portions of the side wall of the metal container being necked by the necking die is 0.0005 inch or less as the necking die is narrowing said portions. The maximum clearance between the knockout and the portions of the side wall of the metal container being necked by the necking die that is capable of supporting will depend on alloy, temper, thickness, and variation in thickness of the metal container.

In some embodiments, capable of supporting means that during necking and when the knockout is inserted or partially inserted into the metal container the clearance between the knockout and the portions of the side wall of the metal container being necked by the necking die is 0.003 inch or less as the necking die is narrowing said portions.

In some embodiments, capable of supporting means that during necking and when the knockout is inserted or partially inserted into the metal container the clearance between the knockout and the portions of the side wall of the metal container being necked by the necking die is 0.002 inch or less as the necking die is narrowing said portions.

In some embodiments, capable of supporting means that during necking and when the knockout is inserted or partially inserted into the metal container the clearance between the knockout and the portions of the side wall of the metal container being necked by the necking die is 0.0015 inch or less as the necking die is narrowing said portions.

In some embodiments, capable of supporting means that during necking and when the knockout is inserted or partially inserted into the metal container the clearance between the knockout and the portions of the side wall of the metal container being necked by the necking die is 0.001 inch or less as the necking die is narrowing said portions.

In some embodiments of the die system, the second inner diameter of the container side wall is closer to the opening of the metal container than the first inner diameter of the container side wall. In some embodiments of the die system, the first knockout outer diameter is capable of passing through the second inner diameter of the side wall after necking when extracting the knockout from the metal container. In some embodiments of the die system, the first inner diameter of the container side wall is at least 0.0015 inches greater than the second inner diameter of the container side wall. In some embodiments of the die system, the first inner diameter of the container side wall is at least 0.002 inches greater than the second inner diameter of the container side wall. In some embodiments of the die system, the first inner diameter of the container side wall is at least 0.0025 inches greater than the second inner diameter of the container side wall. In some embodiments of the die system, the first inner diameter of the container side wall is at least 0.003 inches greater than the second inner diameter of the container side wall. In some embodiments of the die system, the first inner diameter of the container side wall is at least 0.004 inches greater than the second inner diameter of the container side wall. In some embodiments of the die system, the first inner diameter of the container side wall is at least 0.005 inches greater than the second inner diameter of the container side wall.

In some embodiments of the die system, the necking die further comprises a relief; wherein the working surface further comprises a neck radius portion and a shoulder radius portion; wherein the land, neck radius portion, and the shoulder radius portion each have an inner diameter; wherein the land is between the neck radius portion and the relief and the inner diameter of the land is a minimum diameter of the necking die; wherein the inner diameters of the neck radius portion and the shoulder radius portion are greater than the inner diameter of the land; wherein the relief comprises a relief surface; wherein an inner diameter of the relief surface is at least about 0.01 inches greater than the inner diameter of the land portion; wherein the inner diameter of the relief surface is no greater than a maximum diameter so as to reduce but not eliminate frictional contact between the metal container and the relief surface while maintaining necking performance when necking the metal container; and wherein the necking die is dimensioned so that when necking the metal container, the entire land and the relief travel relative to the metal container in an axial direction and at least a portion of the relief travels into the opening of the metal container. In some embodiments of the die system, the metal container has a closed bottom. In some embodiments of the die system, the metal container was formed by drawing and ironing.

In some embodiments of the die system, there is a smooth transition between the first inner diameter of the container side wall and the second inner diameter of the container side wall. A smooth transition means linear taper from one sidewall thickness to another.

In some embodiments of the die system, the first knockout outer diameter is at least 0.001 inches greater than the second knockout outer diameter. In some embodiments of the die system, the first knockout outer diameter is at least 0.0015 inches greater than the second knockout outer diameter. In some embodiments of the die system, the first knockout outer diameter is at least 0.002 inches greater than the second knockout outer diameter. In some embodiments of the die system, the first knockout outer diameter is at least 0.0025 inches greater than the second knockout outer diameter. In some embodiments of the die system, the first knockout outer diameter is at least 0.003 inches greater than the second knockout outer diameter. In some embodiments of the die system, the first knockout outer diameter is at least 0.004 inches greater than the second knockout outer diameter. In some embodiments of the die system, the first knockout outer diameter is at least 0.005 inches greater than the second knockout outer diameter.

In some embodiments of the die system, the first inner diameter of the container side wall is no more than 0.006 inches greater than the second inner diameter of the container side wall. In some embodiments of the die system, the first inner diameter of the container side wall is no more than 0.005 inches greater than the second inner diameter of the container side wall. In some embodiments of the die system, the first inner diameter of the container side wall is no more than 0.004 inches greater than the second inner diameter of the container side wall.

In some embodiments of the die system, the first knockout outer diameter is no more than 0.006 inches greater than the second knockout outer diameter. In some embodiments of the die system, the first knockout outer diameter is no more than 0.005 inches greater than the second knockout outer diameter. In some embodiments of the die system, the first knockout outer diameter is no more than 0.004 inches greater than the second knockout outer diameter.

In some embodiments of the die system, the transition between the first inner diameter of the container side wall and the second inner diameter of the container side wall substantially matches the transition between the first knockout outer diameter and the second knockout outer diameter. "Substantially matches" means the profile of the knockout at the transition mirrors the transition of the inner diameter of the container side wall, i.e. the distance between the outer diameter of the knockout and the inner diameter of the container side wall remain constant along the height of their respective transitions. In some embodiments of the die system, the container side wall has a third inner diameter and the support surface of the knockout has a third knockout outer diameter capable of supporting the third inner diameter of the container side wall when the knockout is inserted into the opening of the metal container and when the metal container is being necked with the necking die.

In some embodiments, the inner diameter container side wall is tapered and/or comprises multiple tapered segments.

One embodiment of a method of necking a metal container comprises: (A) moving a necking die over an open end of a metal container, wherein the necking die comprises a working surface having a land, and wherein the metal container comprises; (i) an opening; and (ii) a side wall, wherein the side wall has: (a) a first inner diameter; and (b) a second inner diameter; wherein the first inner diameter is at least 0.001 inches greater than the second inner diameter; (B) inserting a knockout into the opening of the metal container, wherein the knockout comprises: (i) a first knockout outer diameter capable of supporting the first inner diameter of the side wall when the knockout is inserted into the opening of the metal container and when the necking die is over the open end of the metal container; and (ii) a second knockout outer diameter capable of supporting the second inner diameter of the side wall when the knockout is inserted into the opening of the metal container and when the necking die is over the open end of the metal container, wherein the first knockout outer diameter is larger than the second knockout outer diameter, (C) removing the necking die from the metal container; and (D) removing the knockout from the metal container; wherein when removing the knockout from the metal container the first knockout outer diameter passes through the second inner diameter of the side wall.

In one embodiment of the method, the inserting the knockout step (B) occurs before the moving the necking die over the open end of the metal container step (A).

In one embodiment of the method, the removing the necking die from the metal container step (C) occurs before the removing the knockout from the metal container step (D).

In one embodiment of the method, the second inner diameter of the container side wall is closer to the opening of the metal container than the first inner diameter of the container side wall.

In some embodiments of the method, the first inner diameter of the container side wall is at least 0.0015 inches greater than the second inner diameter of the container side wall. In some embodiments of the method, the first inner diameter of the container side wall is at least 0.002 inches greater than the second inner diameter of the container side wall. In some embodiments of the method, the first inner diameter of the container side wall is at least 0.0025 inches greater than the second inner diameter of the container side wall. In some embodiments of the method, the first inner diameter of the container side wall is at least 0.003 inches greater than the second inner diameter of the container side wall. In some embodiments of the method, the first inner diameter of the container side wall is at least 0.004 inches greater than the second inner diameter of the container side wall. In some embodiments of the method, the first inner diameter of the container side wall is at least 0.005 inches greater than the second inner diameter of the container side wall.

In one embodiment of the method, the necking die further comprises a relief and the working surface of the necking die further comprises a neck radius portion and a shoulder radius portion; wherein the land, neck radius portion, and the shoulder radius portion each having an inner diameter; wherein the land is between the neck radius portion and the relief and the inner diameter of the land is a minimum diameter of the necking die; wherein the inner diameters of the neck radius portion and the shoulder radius portion are greater than the inner diameter of the land; wherein the relief comprises a relief surface; wherein an inner diameter of the relief surface is at least about 0.01 inches greater than the inner diameter of the land portion; wherein the inner diameter of the relief surface is no greater than a maximum diameter so as to reduce but not eliminate frictional contact between the metal container and the relief surface while maintaining necking performance when necking the metal container; and wherein the necking die is dimensioned so that when necking the metal container, the entire land and the relief travel relative to the metal container in an axial direction and at least a portion of the relief travels into the opening of the metal container.

In some embodiments of the method, the metal container has a closed bottom. In some embodiments of the method, the metal container was formed by drawing and ironing.

In some embodiments of the method, there is a smooth transition between the first inner diameter of the container side wall and the second inner diameter of the container side wall.

In some embodiments of the method, the first knockout outer diameter is at least 0.001 inches greater than the second knockout outer diameter. In some embodiments of the method, the first knockout outer diameter is at least 0.002 inches greater than the second knockout outer diameter.

In some embodiments of the method, the first inner diameter of the container side wall is no more than 0.006 inches greater than the second inner diameter of the container side wall. In some embodiments of the method, the first inner diameter of the container side wall is no more than 0.005 inches greater than the second inner diameter of the container side wall. In some embodiments of the method, the first inner diameter of the container side wall is no more than 0.004 inches greater than the second inner diameter of the container side wall.

In some embodiments of the method, the first knockout outer diameter is no more than 0.006 inches greater than the second knockout outer diameter. In some embodiments of the method, the first knockout outer diameter is no more than 0.005 inches greater than the second knockout outer diameter. In some embodiments of the method, the first knockout outer diameter is no more than 0.004 inches greater than the second knockout outer diameter.

In some embodiments of the method, the transition between the first inner diameter of the container side wall and the second inner diameter of the container side wall substantially matches the transition between the first knockout outer diameter and the second knockout outer diameter.

In some embodiments of the method, the container side wall has a third inner diameter and wherein the support surface of the knockout has a third knockout outer diameter capable of supporting the third inner diameter of the container side wall when the knockout is inserted into the opening of the metal container and when the metal container is being necked with the necking die.

One embodiment of a knockout comprises: a first knockout outer diameter capable of supporting a first inner diameter of a side wall of a metal container when the knockout is inserted into an opening of the metal container and when the metal container is being necked with a necking die; and a second knockout outer diameter capable of supporting a second inner diameter of the side wall when the knockout is inserted into the opening of the metal container and when the metal container is being necked with the necking die, wherein the first knockout outer diameter is at least 0.001 inch larger than the second knockout outer diameter.

In some embodiments of the knockout, the first knockout outer diameter is capable of passing through the second inner diameter of the side wall after necking when extracting the knockout from the metal container.

In some embodiments of the knockout, the first knockout outer diameter is at least 0.002 inch greater than the second knockout outer diameter.

In some embodiments of the knockout, the metal container has a closed bottom. In some embodiments of the knockout, the metal container was formed by drawing and ironing.

In some embodiments of the knockout, there is a smooth transition between the first knockout outer diameter and the second knockout outer diameter.

In some embodiments of the knockout, the first knockout outer diameter is no more than 0.006 inches greater than the second knockout outer diameter.

In some embodiments of the knockout, the first knockout outer diameter is no more than 0.005 inches greater than the second knockout outer diameter. In some embodiments of the knockout, the first knockout outer diameter is no more than 0.004 inches greater than the second knockout outer diameter.

In some embodiments of the knockout, the transition between the first knockout outer diameter and the second knockout outer diameter substantially matches the transition between the first inner diameter of the side wall and the second inner diameter of the side wall.

In some embodiments of the knockout, the knockout has a third knockout outer diameter capable of supporting a third inner diameter of the side wall when the knockout is inserted into the opening of the metal container and when the metal container is being necked with the necking die.

DESCRIPTION

For the purposes of this specification, terms such as top, bottom, below, above, under, over, etc. are relative to the position of a finished metal container wherein the base of the metal container is resting on a flat surface, regardless of the orientation of the metal container during manufacturing or forming steps or processes. A finished metal container is a metal container that will not undergo additional forming steps before it is used by an end consumer. In some embodiments, the top of the container has an opening.

Figure 1:
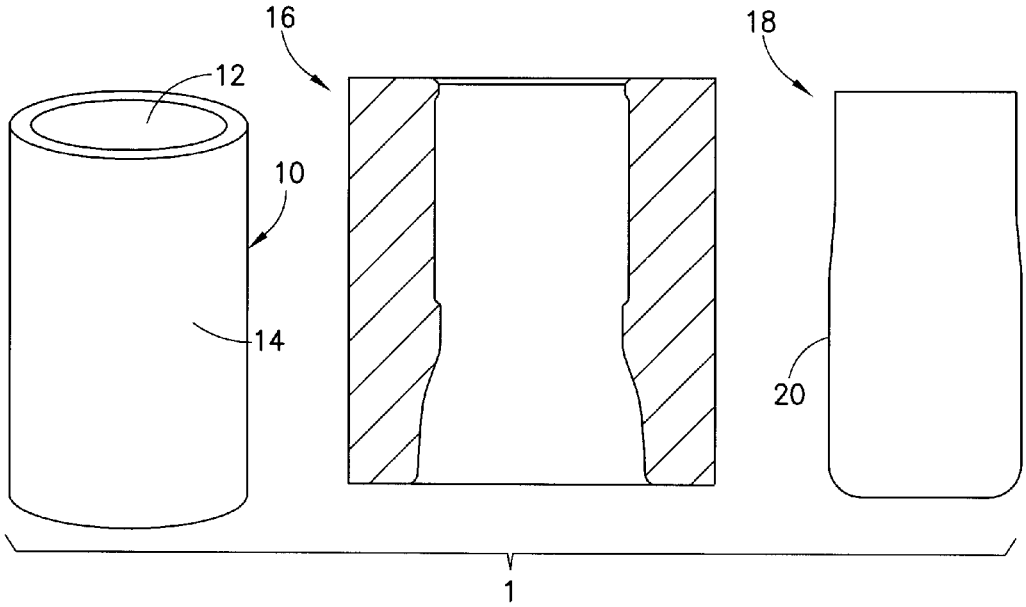
FIG. 1 is a die system including a side view of a pre-form metal container, a side cross-sectional view of a necking die and a side cross-sectional view of knockout according to one embodiment.

FIG. 1 shows a die system 1 according to one embodiment of the invention. In this embodiment, the die system 1 comprises a metal container 10, a necking die 16 and a knockout 18. The metal container 10 has an opening 12 and a container side wall 14. The knockout 18 comprises a support surface 20.

Figure 2:
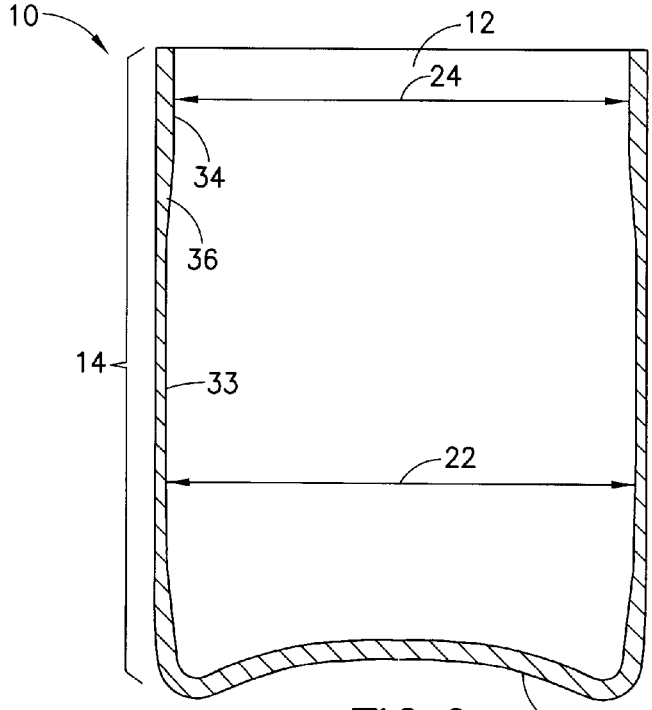
FIG. 2 is a side cross-sectional view of the pre-form metal container of FIG. 1.

FIG. 2 illustrates the metal container 10 in more detail. The metal container 10 has a closed bottom forming a base 15. The container side wall 14 has a first inner diameter 22 and a second inner diameter 24, wherein the first inner diameter 22 of the container side wall 14 is at least 0.001 inches greater than the second inner diameter 24 of the container side wall 14. The portion of the side wall 14 of the container 10 having the first inner diameter 22 is referred to a thin wall 33. The portion of the side wall 14 of the container 10 having the second inner diameter 22 is referred to a thick wall 34. There is a smooth transition 36 between the first inner diameter 22 of the container side wall 14 and the second inner diameter 24 of the container side wall 14 and also between the thin wall 33 and the thick wall 34. In some embodiments, the first inner diameter 22 of the container side wall 14 is at least 0.0015 inches greater than the second inner diameter 24 of the container side wall 14. In some embodiments, the first inner diameter 22 of the container side wall 14 is at least 0.002 inches greater than the second inner diameter 24 of the container side wall 14. In some embodiments, the first inner diameter 22 of the container side wall 14 is at least 0.0025 inches greater than the second inner diameter 24 of the container side wall 14. In other embodiments, the first inner diameter 22 of the container side wall 14 is at least 0.003 inches greater than the second inner diameter 24 of the container side wall 14. In some embodiments, the first inner diameter 22 of the container side wall 14 is at least 0.004 inches greater than the second inner diameter 24 of the container side wall 14. In some embodiments, the first inner diameter 22 of the container side wall 14 is at least 0.005 inches greater than the second inner diameter 24 of the container side wall 14.

As can be observed in the illustrated embodiment, the second inner diameter 24 of the container side wall 14 is closer to the opening 12 of the metal container 10 than the first inner diameter 22 of the container side wall 14.

In some embodiments of the die system, the first inner diameter of the container side wall is no more than 0.006 inches greater than the second inner diameter of the container side wall. In some embodiments of the die system, the first inner diameter of the container side wall is no more than 0.005 inches greater than the second inner diameter of the container side wall. In some embodiments of the die system, the first inner diameter of the container side wall is no more than 0.004 inches greater than the second inner diameter of the container side wall.

Figure 3:
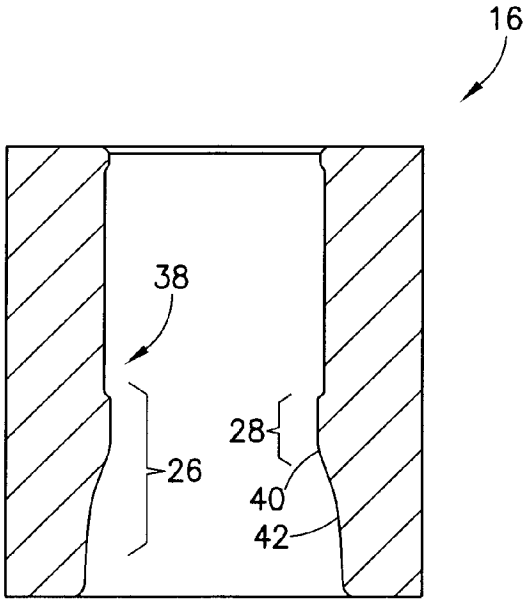
FIG. 3 is a side cross-sectional side view of the necking die of FIG. 1.

The necking die 16, illustrated in FIG. 3, has a working surface 26 comprising a land 28 a neck radius portion 40 and shoulder radius portion 42. A relief 38 is also shown. The land 28 is between the neck radius portion 48 and the relief 38. The inner diameters of the neck radius portion 40 and the shoulder radius portion 42 are greater than the inner diameter of the land 28. The inner diameter of the land 28 is a minimum diameter of the necking die 16.

Figure 4:
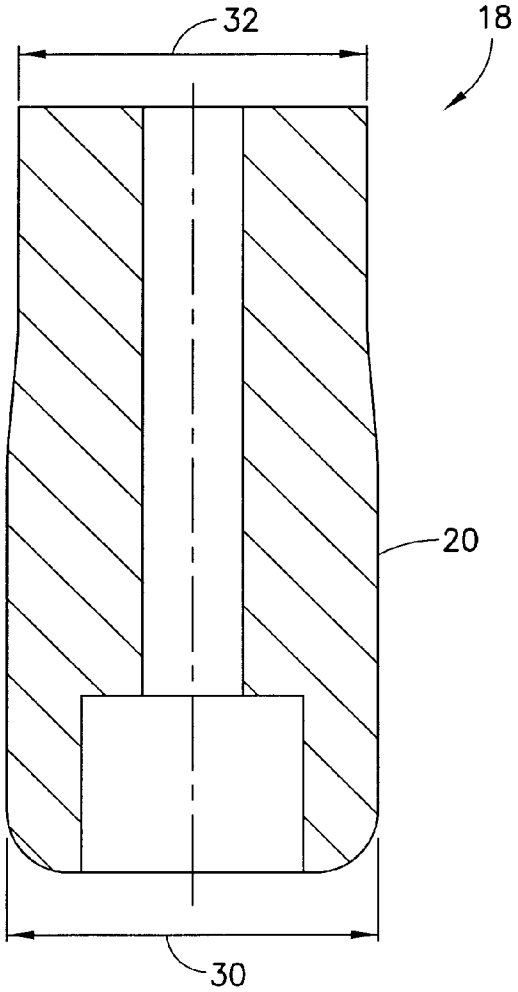
FIG. 4 is a side cross-sectional side view of the knockout of FIG. 1.

As shown in FIG. 4, the knockout 18 has a support surface 20. The support surface 20 has a first knockout outer diameter 30 capable of supporting the first inner diameter 22 of the container side wall 14 when the knockout 18 is inserted into the opening 12 of the metal container 10 and when the metal container 10 is being necked with the necking die 16; and a second knockout outer diameter 32 capable of supporting the second inner diameter 24 of the container side wall 14 when the knockout 18 is inserted into the opening 12 of the metal container 10 and when the metal container 10 is being necked with the necking die 16. As can be observed in FIG. 4, the first knockout outer diameter 30 is larger than the second knockout outer diameter 32. However, the first knockout outer diameter 30 is capable of passing through the second inner diameter 24 of the side wall 14 after necking when extracting the knockout 18 from the metal container 10. Even though the first knockout outer diameter 30 is larger than the second inner diameter 24 of the side wall 14 after necking, the first knockout outer diameter 30 is capable of passing through the second inner diameter 24 of the side wall 14 after necking without damaging the metal container 10 because there will be a certain degree of spring-back in the side wall 14 of the metal container 10. The amount of spring-back will be determined by the thickness, temper, diameter of the container, and alloy of the metal comprising the metal container 10. The first knockout outer diameter 30 is at least 0.001 inches greater than the second knockout outer diameter 24. In some embodiments the first knockout outer diameter is at least 0.0015 inches greater than the second knockout outer diameter. In some embodiments, the first knockout outer diameter is at least 0.002 inches greater than the second knockout outer diameter. In some embodiments, the first knockout outer diameter is at least 0.0025 inches greater than the second knockout outer diameter. In some embodiments, the first knockout outer diameter is at least 0.003 inches greater than the second knockout outer diameter. In some embodiments, the first knockout outer diameter is at least 0.004 inches greater than the second knockout outer diameter.

In some embodiments of the die system, the first knockout outer diameter is no more than 0.0060 inches greater than the second knockout outer diameter. In some embodiments of the die system, the first knockout outer diameter is no more than 0.005 inches greater than the second knockout outer diameter. In some embodiments of the die system, the first knockout outer diameter is no more than 0.004 inches greater than the second knockout outer diameter.

Figure 5:
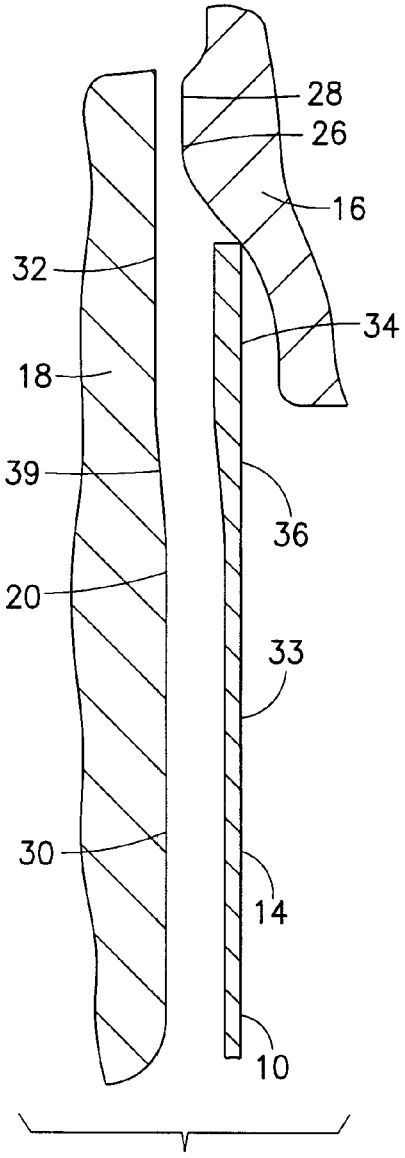
FIG. 5 is a partial side cross-sectional view of the pre-form metal container, the necking die and the knockout of FIG. 1 as the necking die is about to narrow the pre-form metal container.
Figure 6:
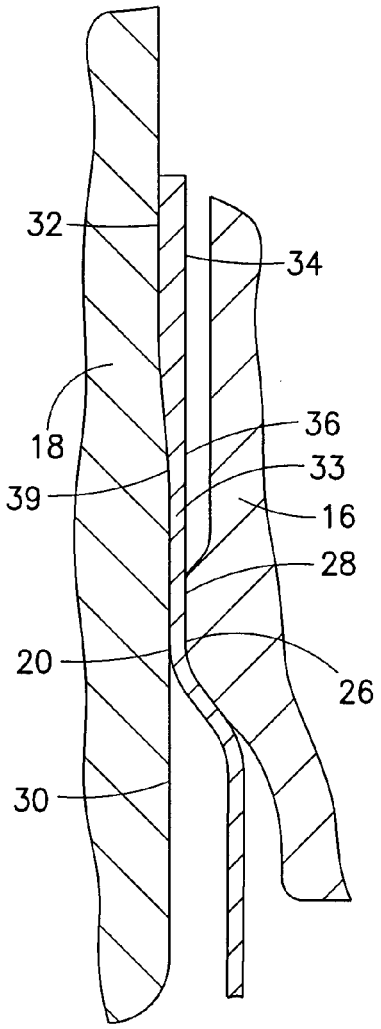
FIG. 6 is a partial side cross-sectional view of the pre-form metal container, the necking die and the knockout of FIG. 1 as the necking die is narrowing the metal container.

As can be observed in FIGS. 5 and 6, the transition 36 between the first inner diameter 22 of the container side wall 14 and the second inner diameter 24 of the container side wall 14 substantially matches the transition 39 between the first knockout outer diameter 30 and the second knockout outer diameter 32.

In operation of the die system 1, in FIG. 1, to neck the metal container 10, according to one embodiment, the knockout 18 is inserted into the opening 12 of the metal container 10. Then, the necking die 16 travels over the opening 12 of the metal container 10. FIG. 5 shows the knockout 18 inside the metal container 10, with the necking die 16 about to slide over the metal container 10. As the necking die 16 travels over the opening 12 of the metal container 10, the first knockout outer diameter 30 supports the first inner diameter 22 of the side wall 14 of the metal container 10 and the second knockout outer diameter 32 supports the second inner diameter 24 of the side wall 14 of the metal container 10, as shown in FIG. 6. Then the necking die 16 is removed from the metal container 10. Finally, the knockout 18 is removed from the metal container 10, wherein when removing the knockout 18 from the metal container 10 the first knockout outer knockout diameter 20 passes through the second inner diameter 24 of the side wall 14.

In some embodiments, the necking die 16 begins to travels over the opening 12 of the metal container 10 after the knockout 18 begins to be inserted into the metal container 10 but before the knockout 18 is fully inserted into the metal container 10.

In some embodiments, the necking die 16 begins to travels over the opening 12 of the metal container 10 after the knockout 18 begins to be inserted into the metal container 10 but before the knockout 18 is fully inserted into the metal container 10. Once the knockout 18 is fully inserted in to the metal container 10 it stops moving while the necking die 16 completes the end of its stroke and begins to move off of the metal container. Then the knockout 18 exits the metal container 10.

Figure 8:
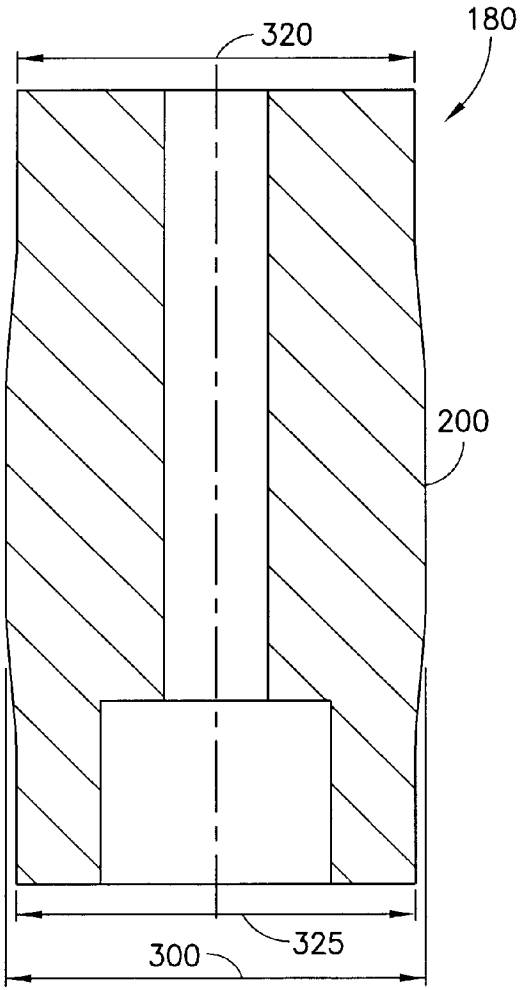
FIG. 8 is a side cross-sectional side view of a knockout according to another embodiment.
Figure 7:
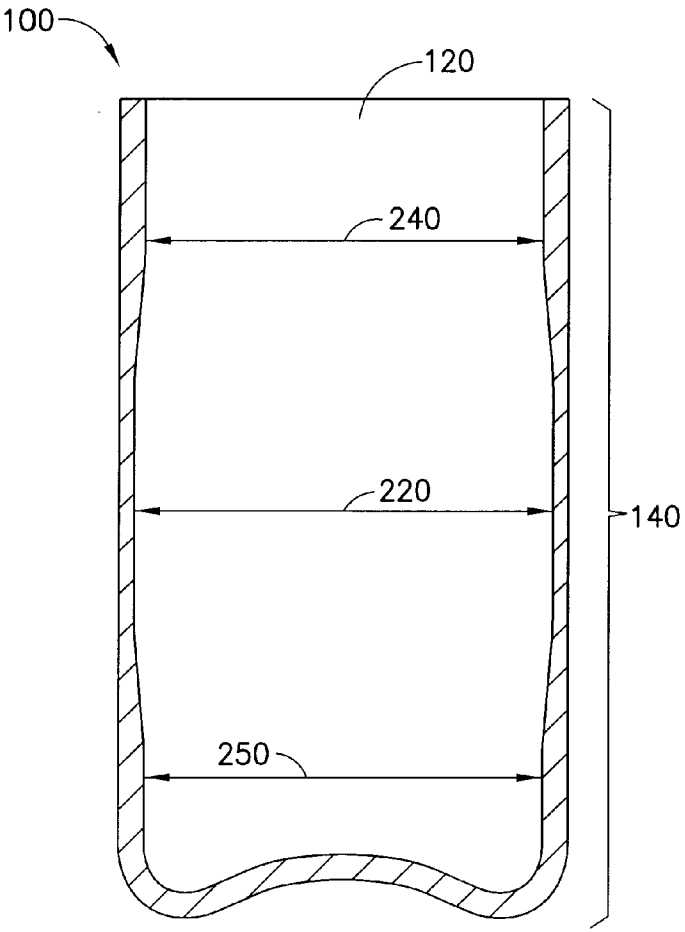
FIG. 7 is a side cross-sectional side view of a pre-form metal container according to another embodiment.

Alternative embodiments of a metal container 100 and a knockout 180 are shown in FIGS. 7 and 8, respectively. The metal container 100 has a container side wall 140 and the container side wall has a first inner diameter 220, a second inner diameter 240 and a third inner diameter 250. The support surface 200 of the knockout 180 has a first knockout outer diameter 300 capable of supporting the first inner diameter 220 of the container side wall 140 when the knockout 180 is inserted into the opening 120 of the metal container 100 and when the metal container 100 is being necked with a necking die. The support surface 200 of the knockout 180 also has a second knockout outer diameter 320 capable of supporting the second inner diameter 240 of the container side wall 140 when the knockout 180 is inserted into the opening 120 of the metal container 100 and when the metal container 100 is being necked with a necking die. Finally, the support surface 200 has a third knockout outer diameter 325 capable of supporting the third inner diameter 250 of the container side wall 140 when the knockout 180 is inserted into the opening 120 of the metal container 100 and when the metal container 100 is being necked with a necking die.

Figure 9:
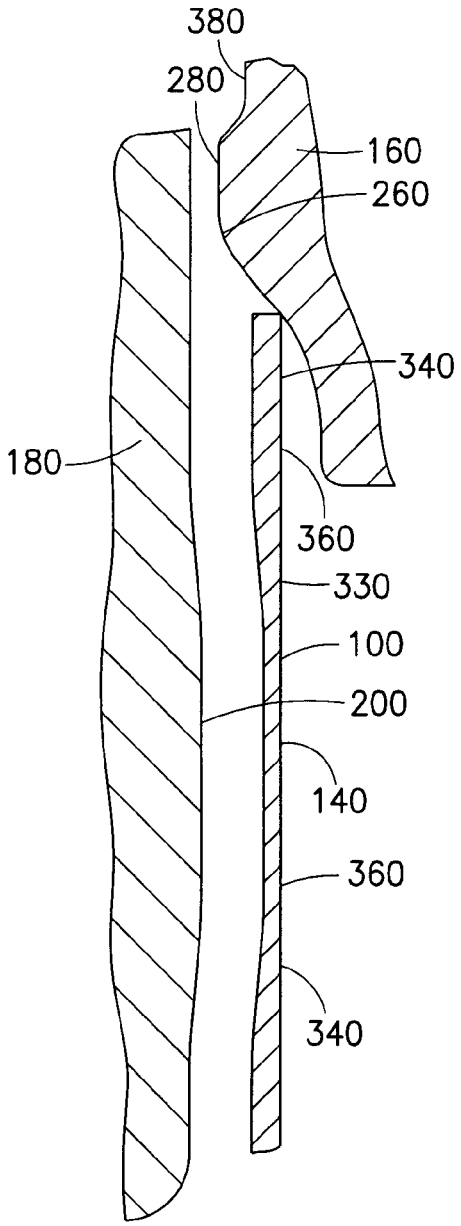
FIG. 9 is a partial side cross-sectional view of the pre-form metal container of FIG. 7, the knockout of FIG. 8 and a necking die as the necking die is about to narrow the pre-form metal container.
Figure 10:
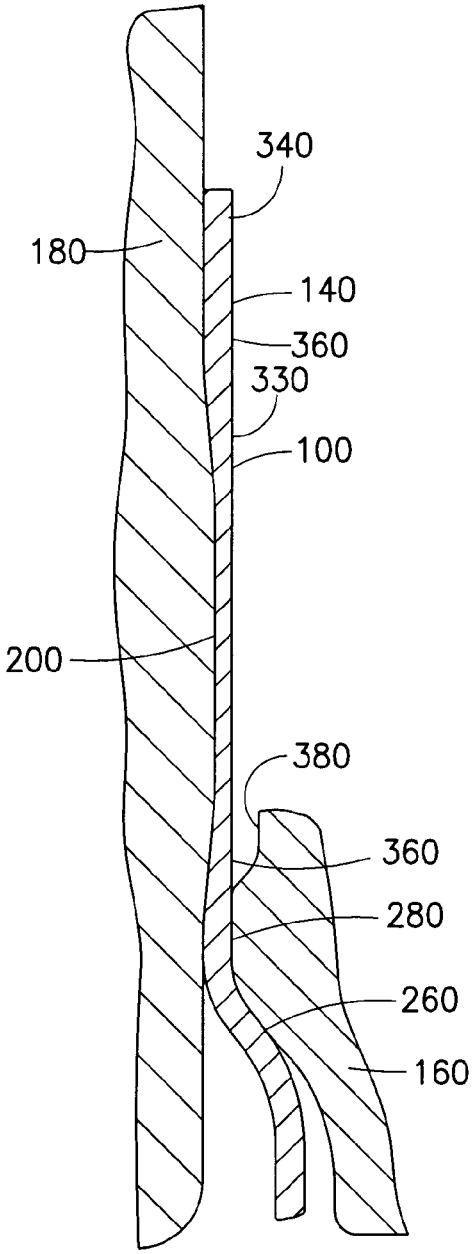
FIG. 10 is a partial side cross-sectional view of the pre-form metal container of FIG. 7, the knockout of FIG. 8 and a necking die as the necking die is narrowing the metal container.

FIG. 9 shows the knockout 180 inside the metal container 100, with a necking die 160 about to slide over the metal container 100. In operation, as the necking die 160 travels over the opening 120 of the metal container 100, the first knockout outer diameter 300 supports the first inner diameter 220 of the side wall 140 of the metal container 100 and the second knockout outer diameter 320 supports the second inner diameter 240 of the side wall 140 of the metal container 100 and the third knockout outer diameter 325 supports the second inner diameter 250 of the side wall 140 of the metal container 100, as shown in FIG. 10.

EXAMPLES

In one example embodiment, the thick wall portion of the metal container is 0.006 inch thick and the thin wall portion of the metal container is 0.004 inch thick. In another example, the thick wall portion of the metal container is 0.008 inch thick and the thin wall portion of the metal container is 0.006 inch thick. In a further example, the thick wall portion of the metal container, comprising a 211 can, is 0.0058 inch thick and the thin wall portion of the metal container is 0.0038 inch thick. In yet another example, the thick wall portion of the metal container is 0.006 inch thick and the thin wall portion of the metal container is 0.0038 inch thick. In a further example, the thick wall portion of the metal container is 0.0058 inch thick and the thin wall portion of the metal container is 0.0048 inch thick. In a final example, the thick wall portion of the metal container, comprising a 211 can, is 0.0063 inch thick and the thin wall portion of the metal container is 0.0041 inch thick.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means or step for" clause as specified in 35 U.S.C. §112.

The invention claimed is:

1. A die system comprising:

(A) a metal container having:
- (i) an opening;
- (ii) a container side wall, wherein the container side wall has:
  - (a) a first inner diameter; and
  - (b) a second inner diameter; and
  - (c) a transition between the first inner diameter and the second inner diameter wherein the transition of the metal container has a height;
  - wherein the first inner diameter of the container side wall is at least 0.001 inches greater than the second inner diameter of the container side wall;

(B) a necking die having a working surface comprising a land; and (C) a knockout having a support surface, the support surface having:
- (i) a first knockout outer diameter capable of supporting the first inner diameter of the container side wall when the knockout is inserted into the opening of the metal container and when the metal container is being necked with the necking die;
- (ii) a second knockout outer diameter capable of supporting the second inner diameter of the container side wall when the knockout is inserted into the opening of the metal container and when the metal container is being necked with the necking die, and
  - wherein the first knockout outer diameter is larger than the second knockout outer diameter; and
- (iii) a transition between the first knockout outer diameter and the second knockout outer diameter wherein the transition of the knockout has a height; and (D) a clearance between the outer diameter of the knockout and the inner diameter of portions of side wall of the metal container to be necked by the necking die when the knockout is inserted into the opening of the metal container, wherein the clearance comprises a distance and wherein the distance between the outer diameter of the knockout and the inner diameter of the container side wall remains constant along the height of the transition of the metal container and along the height of the transition of the knockout.

2. The die system of claim 1 wherein the container side wall has a length and, along the length of the container side wall, the second inner diameter of the container side wall is closer to the opening of the metal container than the first inner diameter of the container side wall.

3. The die system of claim 1 wherein the first knockout outer diameter is capable of passing through the second inner diameter of the side wall after necking when extracting the knockout from the metal container.

4. The die system of claim 1 wherein the first inner diameter of the container side wall is at least 0.002 inches greater than the second inner diameter of the container side wall.

5. The die system of claim 1 wherein the metal container has a closed bottom.

6. The die system of claim 1 wherein the metal container was formed by drawing and ironing.

7. The die system of claim 1 wherein the first knockout outer diameter is at least 0.001 inches greater than the second knockout outer diameter.

8. The die system of claim 1 wherein the first knockout outer diameter is at least 0.002 inches greater than the second knockout outer diameter.

9. The die system of claim 1 wherein the transition between the first inner diameter of the container side wall and the second inner diameter of the container side wall substantially matches the transition between the first knockout outer diameter and the second knockout outer diameter.

10. The die system of claim 1 wherein the container side wall has a third inner diameter and wherein the support surface of the knockout has a third knockout outer diameter capable of supporting the third inner diameter of the container side wall when the knockout is inserted into the opening of the metal container and when the metal container is being necked with the necking die.

11. A method of necking a metal container comprising:

(A) moving a necking die over an open end of a metal container, wherein the necking die comprises a working surface having a land, and wherein the metal container comprises;

(i) an opening; and (ii) a side wall, wherein the side wall has:

(a) a first inner diameter;

(b) a second inner diameter; and (c) a transition between the first inner diameter and the second inner diameter, wherein the transition of the metal container has a height;

wherein the first inner diameter is at least 0.001 inches greater than the second inner diameter;

(B) Inserting a knockout into the opening of the metal container, wherein the knockout comprises:

(i) a first knockout outer diameter capable of supporting the first inner diameter of the side wall when the knockout is inserted into the opening of the metal container and when the necking die is over the open end of the metal container;

(ii) a second knockout outer diameter capable of supporting the second inner diameter of the side wall when the knockout is inserted into the opening of the metal container and when the necking die is over the open end of the metal container, wherein the first knockout outer diameter is larger than the second knockout outer diameter; and (iii) a transition between the first knockout outer diameter and the second knockout outer diameter wherein the transition of the knockout has a height; and wherein there is a clearance between the outer diameter of the knockout and the inner diameter of portions of side wall of the metal container to be necked by the necking die, wherein the clearance comprises a distance and wherein the distance between the outer diameter of the knockout and the inner diameter of the container side wall remains constant along the height of the transition of the metal container and along the height of the transition of the knockout;

(C) removing the necking die from the metal container; and (E) removing the knockout from the metal container;

wherein when removing the knockout from the metal container the first knockout outer knockout diameter passes through the second inner diameter of the side wall.

12. The method of claim 11 wherein the inserting the knockout step (B) occurs before the moving the necking die over the open end of the metal container step (A).

13. The method of claim 11 wherein the removing the necking die from the metal container step (C) occurs before the removing the knockout from the metal container step (D).

14. The method of claim 11 wherein the container side wall has a length and, along the length of the container side wall, the second inner diameter of the container side wall is closer to the opening of the metal container than the first inner diameter of the container side wall.

15. The method of claim 11 wherein the first inner diameter of the container side wall is at least 0.002 inches greater than the second inner diameter of the container side wall.

16. The method of claim 11 wherein the metal container has a closed bottom.

17. The method of claim 11 wherein the metal container was formed by drawing and ironing.

18. The method of claim 11 wherein the first knockout outer diameter is at least 0.001 inches greater than the second knockout outer diameter.

19. The method of claim 11 wherein the first knockout outer diameter is at least 0.002 inches greater than the second knockout outer diameter.

20. The method of claim 11 wherein the transition between the first inner diameter of the container side wall and the second inner diameter of the container side wall substantially matches the transition between the first knockout outer diameter and the second knockout outer diameter.

21. The method of claim 11 wherein the container side wall has a third inner diameter and wherein the support surface of the knockout has a third knockout outer diameter capable of supporting the third inner diameter of the container side wall when the knockout is inserted into the opening of the metal container and when the metal container is being necked with the necking die.

* * * * *